United States Patent [19]

Johnson et al.

[11] 4,252,306

[45] Feb. 24, 1981

[54] DEVICE FOR CLAMPING BODY PARTS

[75] Inventors: Lanny L. Johnson, Okemos; Donald W. Garnett, Grand Ledge, both of Mich.

[73] Assignee: Lanny L. Johnson, Okemos, Mich.

[21] Appl. No.: 75,682

[22] Filed: Sep. 13, 1979

[51] Int. Cl.[3] ..... A61G 13/00

[52] U.S. Cl. ..... 269/328

[58] Field of Search ..... 269/166–170, 269/328, 236, 196, 274; 254/69–70

[56] References Cited

U.S. PATENT DOCUMENTS

| | | | |
|---|---|---|---|
| 2,323,144 | 6/1943 | Long | 254/69 |
| 2,362,067 | 11/1944 | Heinrich | 269/168 |
| 2,424,313 | 7/1947 | Heinrich | 269/196 |
| 2,735,323 | 2/1956 | Phillips | 269/167 |
| 2,796,787 | 6/1957 | Aske | 269/274 |
| 2,850,342 | 9/1958 | Robinson | 269/328 |

*Primary Examiner*—Robert C. Watson

[57] ABSTRACT

A base member adapted to be secured to an operating table is provided with an upright arm portion. A movable member slidably related to the base member also is provided with an upright arm portion. The base member houses a locking arrangement for securing the movable member in a fixed position with respect to the base member when the upright arms are in position to produce the desired clamping pressure on a body part located between the arms. The locking arrangement also is operative to displace the movable member in incremental steps prior to locking in order to achieve the desired clamping pressure.

6 Claims, 4 Drawing Figures

DEVICE FOR CLAMPING BODY PARTS

BACKGROUND OF THE INVENTION

The present invention is concerned with the problem of restraining various parts of the body to facilitate physical examinations and surgical procedures. It is particularly suitable for use in arthroscopy, arthroscopic surgery and knee surgery.

In the past, a number of devices have been utilized to clamp portions of the body for various procedures. However, known devices historically have suffered one or more important disadvantages such as: difficulty in readily adjusting the device to the body part, limitations in the amount and control of the clamping pressure, unsuitability for attachment to different types of operating tables, impairment of adequate exposure to the body part being worked on, difficulty in providing sterile draping, and the presentation of sanitation problems as a result of the manner of construction of the devices.

SUMMARY OF THE INVENTION

The invention disclosed herein overcomes the deficiencies of previously known devices. More particularly, the improved clamping device comprises a pair of spaced upright arms movable with respect to one another and having means for retaining a closed cell foam pad between the arms to engage the body part as the arms converge. A ratcheting arrangement is provided whereby the operator of the device can increase the clamping pressure incrementally to a desired level at which point the upright arms can be locked against further relative movement.

DETAILED DESCRIPTION OF THE INVENTION

The invention now will be described in greater detail with reference to the accompanying drawings which illustrate a preferred embodiment of the invention and wherein.

Figure 1:
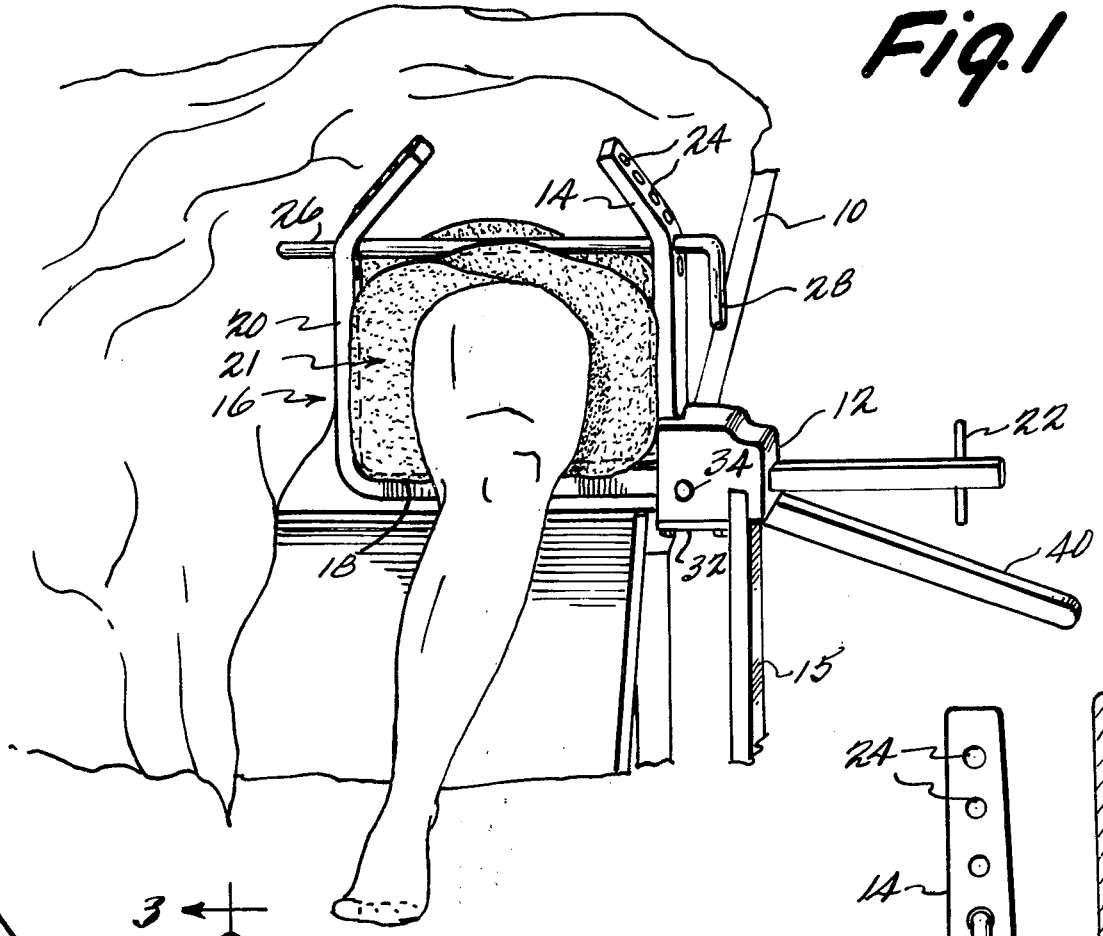
FIG. 1 is a perspective view showing the invention as it is typically used to clamp the thigh of a patient.

Referring first to FIG. 1, there is illustrated an operating table 10 to which the clamp is secured by means to be described hereinafter. The clamp comprises a stationary base member 12 having an arm 14 projecting upwardly therefrom. Base member 12 is adapted to slidably receive a member 16 which includes a horizontal portion 18 and a vertically extending arm portion 20 arranged in parallel spaced relationship with respect to arm 14. Preferably, the cross section of portion 18 of the member 16 is other than circular (e.g., square or rectangular) so that when it is received in correspondingly shaped apertures 19 in base 12, the vertical orientation of arm 20 is assured. A handle 22 is provided at the free end of the horizontal portion 18 of member 16 to facilitate the movement of member 16 with respect to base 12, thereby providing a coarse positioning of the vertical arms 14 and 20 with respect to one another.

In the FIG. 1 illustration, the base 12 is secured to the operating table 10 by means of a fixed arm 15 extending downwardly from the base and passing through a vise-like arrangement (not shown) conventionally used with operating tables. The leg of a patient is positioned between arms 14 and 20 of the clamp. In order to cushion the leg, a pad 21 made of closed cell foam is interposed between the clamp and the leg. Preferably, the foam is contoured so as to include a channel or groove within which arms 14 and 20 and the horizontal portion 18 of member 16 are received, thereby positively positioning the pad with respect to the clamp. The upper ends of arms 14 and 20 are provided with a group of spaced apertures 24 adapted to receive a rod 26 having a handle portion 28 at an end thereof. When the free ends of pad 21 are folded in overlapping relationship over the body part being clamped, rod 26 is inserted into selected holes 24 of arms 14 and 20 to retain the pad in position. Since the rod is slidably received in the arms, the relative movement between the arms is not impaired when member 16 is displaced.

As suggested above, with the patient's leg positioned as shown in FIG. 1, the operator of the device may perform a coarse clamping adjustment by pulling on handle 22 to move arm 20 closer to the stationary arm 14. The manner in which finer adjustment of the clamping pressure is achieved now will be described with reference to FIGS. 2–4.

The base member 12 includes the aforementioned apertures 19 for receiving the horizontal portion 18 of member 14. Additionally, base 12 includes a cavity 30 which is closed by a removable cover 32. A shaft 34 passes through apertures 36 in the walls of base 12 in such a manner that the central axis of the shaft is oriented transversely to the longitudinal axis of the horizontal portion 18 of member 16. Intermediate its ends, the shaft 34 is machined to provide a cylindrical section 38 having its axis parallel to, but offset from, the central axis of the shaft. The shaft 34 and the horizontal portion 18 of member 16 are supported by base 12 in such a manner that the portion 18 is received in the machined area of the shaft with the shaft overlaying portion 18. A handle 40 is secured to an end of shaft 34 which projects beyond base 12. With the handle in the position shown in FIGS. 2 and 3, section 38 of the shaft is spaced from portion 18 of member 16 thereby permitting portion 18 to be slidably moved with respect to base 12. However, when handle 40 is moved to the position illustrated in FIG. 4 (and in FIG. 1), section 38 moves into engagement with portion 18 due to the eccentric relationship between section 38 and the central axis of shaft 34 about which the shaft is rotated as the handle 40 is displaced. The portion 18 is locked with respect to the base 12 when the section 38 rotates to an over-center position. Consequently, arms 14 and 20 become fixed with respect to one another. The locking relationship is terminated by returning the handle 40 to the position shown in FIGS. 2 and 3.

Figure 2:
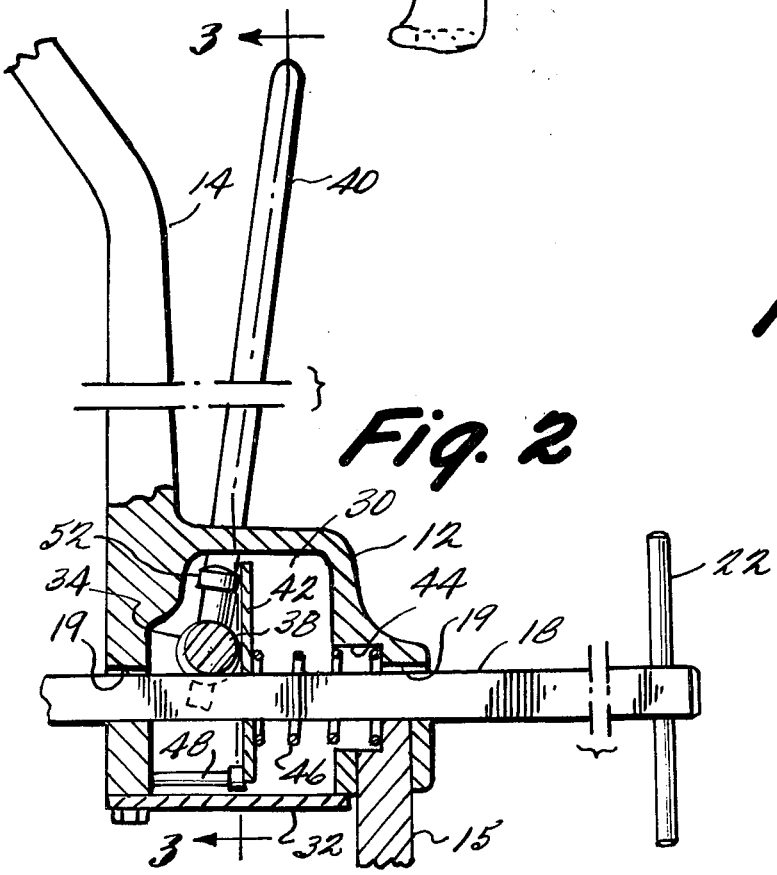
FIG. 2 is an elevational view, partially in section illustrating a portion of the clamp in an unlocked position.
Figure 4:
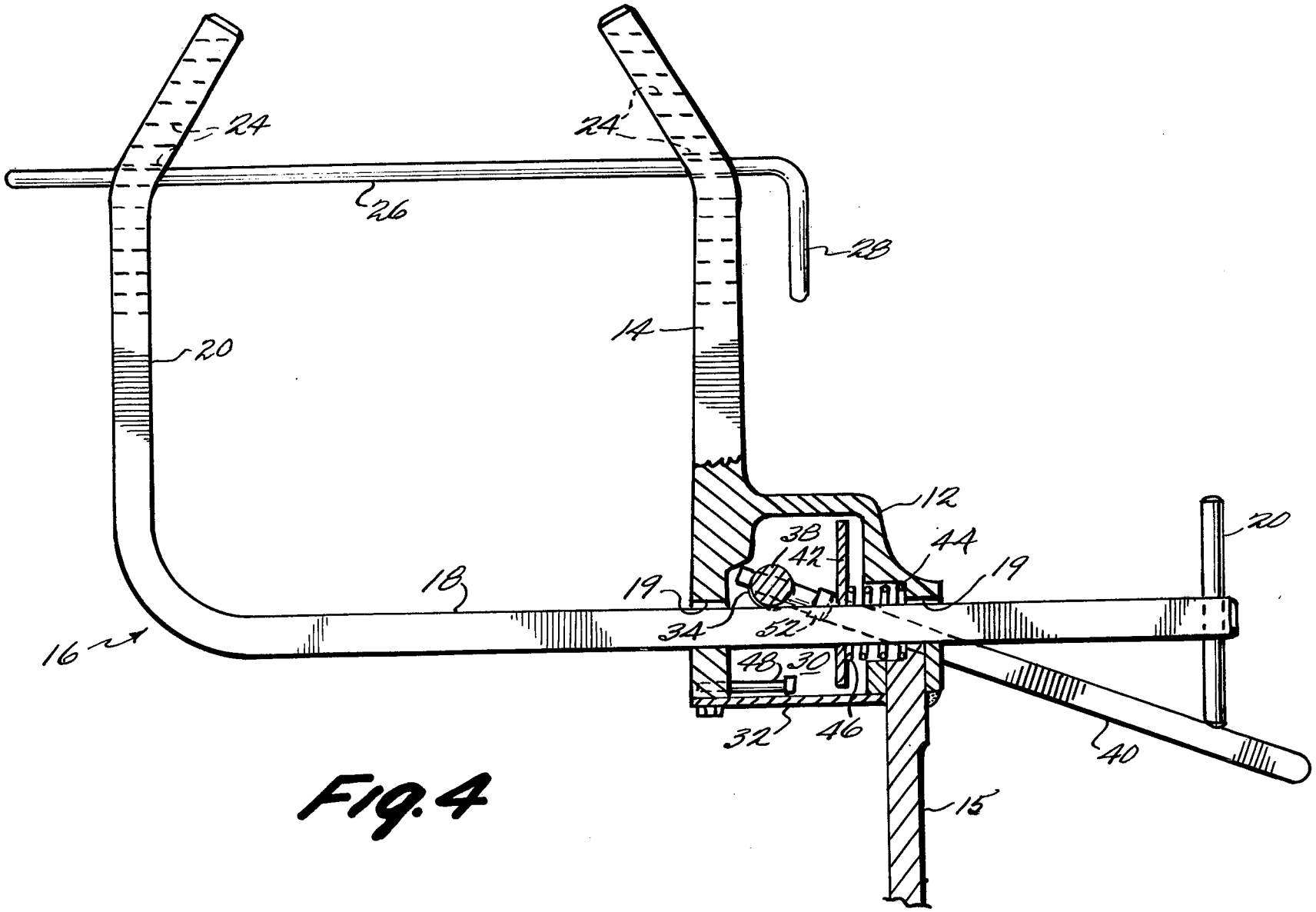
FIG. 4 is an elevational view, partially in section, illustrating the clamp in a locked position.

As can be seen in FIGS. 2 and 4, a plate 42 is located within the cavity 30 in base 12. The plate is provided with an aperture through which portion 18 of member 16 passes. Thus, the plate is adapted to be slidably movable with respect to portion 18. A shouldered recess 44 is provided within the cavity 30 to receive an end of a compression spring 46 which is coiled about portion 18. The opposite end of spring 46 engages plate 42 and urges it towards the shaft 34. A stop member 48 is provided in cavity 30 to limit the movement of the bottom portion of plate 42 in the direction in which the spring urges the plate. A pair of bolts 50 and 52 are secured to shaft 34 on opposite sides of the eccentric section 38. The bolts are arranged to project from the shaft with their axes substantially parallel to that of handle 40. The projections provide multiple functions, one of which is to limit the opening movement of handle 40 by engaging the interior wall of cavity 30.

Figure 3:
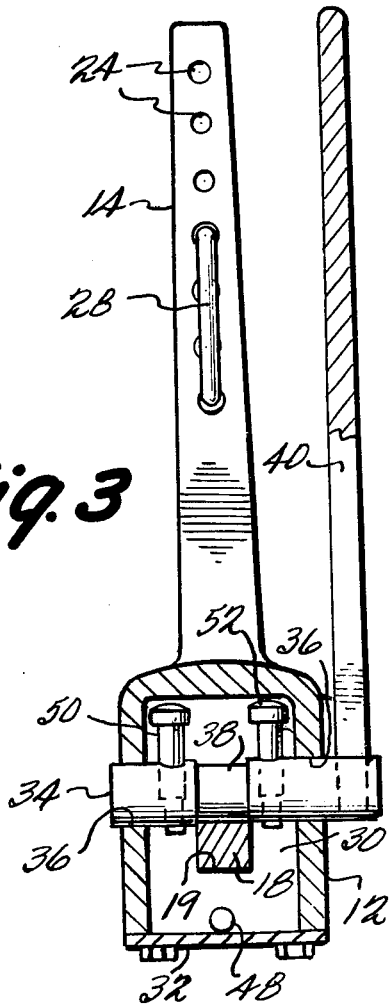
FIG. 3 is a sectional view taken along line 3—3 of FIG. 2.

In the position shown in FIGS. 2 and 3, the movement of plate 42 under the urging of spring 46 is arrested by stop member 48 and by the engagement of the plate with shaft 34 and/or the projecting ends of bolts 50 and 52. When the plate is so oriented, portion 18 of member 16 is free to slidably move with respect to the plate. However, as handle 40 is moved towards the locking position shown in FIG. 4, the bolts 50 and 52 engage the upper portion of plate 42 to tilt it with respect to its bottom portion, thereby causing the plate to be brought into binding engagement with portion 18 of member 16. Continued rotation of the handle is translated through shaft 34, bolts 50 and 52, and plate 42 causing movement of member 16 with respect to the base 12 until the handle is sufficiently rotated so as to lock member 16 as previously described. As is apparent from the explanation just presented, the actuation of handle 40 causes incremental movement of member 16 relative to base 12. When the handle is moved to the upright position shown in FIGS. 2 and 3, the spring 46 returns plate 42 to its nonbinding position with respect to portion 18 of member 16. Thus, if a series of oscillatory actuations of the handle 40 are employed, and the operator holds handle 22 to prevent the spreading of arms 14 and 20 as the handle 40 is periodically moved to the open position, a ratcheting action is achieved whereby the movable arm 20 is brought closer to arm 14 in steps permitting a fine adjustment of the clamping force on the body part. Of course, such ratcheting provides the operator with a feel of the pressure being applied by the clamp while simultaneously affording substantial mechanical leverage in increasing the clamping pressure.

To summarize the operation of the device, the handle 40 is positioned as shown in FIGS. 2 and 3 whereby the member 16 is free to move with respect to base 12. Through the use of handle 22, the operator spreads arms 14 and 20 sufficiently to permit the body part to be introduced between the arms so as to rest on pad 21. The pad is wrapped around the body part and is detained in place by the selective positioning of rod 26 in apertures 24 in the arms. The handle 22 is then employed to provide a coarse adjustment of the clamping pressure of the arms 14 and 20 on the body part. Thereafter, handle 40 is oscillated to incrementally narrow the distance between the arms, thereby increasing the clamping pressure. When the body part is secured to the degree desired, handle 40 is rotated to the over-center position of the eccentric section 38 of shaft 34 whereby section 38 locks portion 18 of member 16 against further movement. On return of handle 40 to the position shown in FIGS. 2 and 3, the locking action of section 38 and plate 42 on portion 18 is released, and by actuation of handle 22, the arms 14 and 20 are separated.

The arrangement which has been described provides improved control and sustained maintenance of clamping pressure, assures proper exposure to the body part being worked on, facilitates sterile draping, provides a smooth interior absent of rack teeth or screw threads which tend to entangle with operating personnel and materials and create sanitation problems, and permits easy installation on most operating tables.

While the arrangement has been described as being particularly useful in clamping a portion of the leg, it is apparent that it is suitable for clamping other body parts.

What is claimed is:

1. A device for clamping parts of the body, comprising:

a base member adapted to be supported in a fixed position;

a first arm projecting from said base member;

a movable member slidably received by the base member to permit relative movement therebetween, said movable member including a portion passing through apertures in the base member on opposite sides thereof, the movable member further including: (1) a second arm positioned at one end of said movable member and arranged in parallel spaced relationship with respect to said first arm and (2) a handle provided at the opposite end of the movable member, actuation of said handle permitting slidable displacement of the movable member with respect to the base member to achieve a coarse adjustment of the spacing between said arms;

cushioning means joined to said first arm and the movable member and occupying a portion of the space between the first and second arms to accommodate a body part;

means for incrementally decreasing the spacing between the arms comprising: means located within a cavity in said base member for selectively engaging said portion of the movable member passing through said cavity; and an additional handle located externally of the base member and operatively connected to said means for selectively engaging the movable member portion, said additional handle being movable in one direction to cause engagement of the selectively engaging means with the movable member portion within the cavity to cause relative movement of said member with respect to the base member in a direction which decreases the spacing between said arms, and the additional handle being movable in the opposite direction to terminate engagement with the movable member portion, whereby repeated oscillatory movement of the additional handle produces incremental decreases in the spacing between the arms; and means for selectively locking said movable member to prevent relative movement thereof with respect to the base member when the first and second arms are at a desired spacing, said locking means comprising cam means joined to the additional handle, said cam means, in response to movement of the additional handle in said one direction in excess of that required to displace the movable member an incremental step, being operative to frictionally engage the portion of the movable member within said cavity thereby preventing further relative movement between the movable member and the base member.

2. A device according to claim 1, wherein said cushioning is provided with overlapping ends located between said first and second arms.

3. A device according to claim 2, further comprising:

means extending between the first and second arms in adjustable spaced relationship from said portion of the movable member to retain said overlapping ends of the cushioning between said arms.

4. A device for clamping parts of the body comprising:

a base member provided with an internal cavity and adapted to be supported in a fixed position;

a first arm projecting vertically from said base member;

a movable member having a horizontally extending portion and a second arm projecting vertically from one end of said portion, the arm being arranged in parallel spaced relationship to said first arm;

cushioning means joined to said first arm and the movable members and occupying a portion of the space between said first and second arms so as to accommodate a body part;

means provided in the base member for slidably receiving the horizontally extending portion of said movable member, said portion passing through the cavity and having its opposite end projecting beyond the base member whereby horizontal displacement of said opposite end permits movement of the movable member with respect to the base member to achieve a coarse adjustment of the spacing between said first and second arms;

a shaft rotatably supported by said base member within said cavity, said shaft having an axis of rotation extending substantially transversely to the horizontally extending portion of the movable member and being provided with cam means located intermediate its ends and adjacent the movable member portion which passes through the cavity;

a handle joined to said shaft externally of said base member, said handle being operative in one direction to move the cam means to frictionally engage the movable member portion;

means operatively related to said shaft and responsive to repeated oscillatory movement of the handle to decrease the spacing between the arms in a series of incremental steps, said means for decreasing the spacing comprising: a plate located within said cavity and having an aperture therein through which the horizontally extending portion of said movable member passes; and spring means within said cavity engaging said plate and urging the plate towards said shaft, said cam means engaging and deflecting the plate in response to movement of the handle in said one direction to establish a binding engagement of the plate and said movable member portion at the aperture whereby further movement of the handle in said one direction is translated into displacement of the movable member portion to decrease the spacing between said arms, whereby still further movement of the handle in said one direction locks the movable member against movement with respect to the base member, and whereby in response to movement of the handle in an opposite direction, the spring returns the plate to nonbinding relationship with respect to the movable member portion.

5. A device according to claim 4, wherein said cushioning is provided with overlapping ends located between said first and second arms.

6. A device according to claim 5, further comprising:

means extending between the first and second arms in adjustable spaced relationship from the horizontal portion of said movable member to retain said overlapping ends of the cushioning between said arms.

* * * * *